US011753847B2

(12) United States Patent
Binek et al.

(10) Patent No.: US 11,753,847 B2
(45) Date of Patent: Sep. 12, 2023

(54) LOCKING MODULE

(71) Applicant: Carrier Corporation, Jupiter, FL (US)

(72) Inventors: Lawrence Binek, Glastonbury, CT (US); Joseph Zacchio, Wethersfield, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 638 days.

(21) Appl. No.: 16/490,384

(22) PCT Filed: Feb. 28, 2018

(86) PCT No.: PCT/US2018/020256

§ 371 (c)(1),
(2) Date: Aug. 30, 2019

(87) PCT Pub. No.: WO2018/160716

PCT Pub. Date: Sep. 7, 2018

(65) Prior Publication Data

US 2020/0018091 A1 Jan. 16, 2020

Related U.S. Application Data

(60) Provisional application No. 62/465,453, filed on Mar. 1, 2017.

(51) Int. Cl.
*E05B 15/00* (2006.01)
*E05B 47/02* (2006.01)

(52) U.S. Cl.
CPC ..... *E05B 15/0073* (2013.01); *E05B 47/023* (2013.01)

(58) Field of Classification Search
CPC ..... E05B 15/006; E05B 15/0073; E05B 47/0038; E05B 47/004; E05B 47/0001;
(Continued)

(56) References Cited

U.S. PATENT DOCUMENTS 5,678,868 A 10/1997 Williams et al.
5,699,698 A 12/1997 Geyer
(Continued)

FOREIGN PATENT DOCUMENTS

EP 0576787 A1 1/1994
EP 1953774 A2 8/2008
(Continued)

OTHER PUBLICATIONS

International Search Report for International Application No. PCT/US2018/020256, International Filing Date Feb. 28, 2018, dated Jun. 4, 2018, 6 pages.

(Continued)

*Primary Examiner* — Christine M Mills
*Assistant Examiner* — Yahya Sidky
(74) *Attorney, Agent, or Firm* — CANTOR COLBURN LLP

(57) ABSTRACT

A locking module for selectively coupling a first component and a second component of a lockable device includes a housing and a magnet arranged within said housing. A locking element is movable relative to said housing between an unlocked position and a locked position. An engagement member is rotatable about an axis to selectively decouple said locking element from said magnet to move said locking element between said unlocked position and said locked position.

15 Claims, 5 Drawing Sheets

(58) Field of Classification Search
CPC ..... E05B 47/0002; E05B 47/0003; E05B 47/0004; E05B 47/0012; E05B 47/06; E05B 47/0603; E05B 47/00; E05B 47/023; E05B 19/0005; E05B 63/121; E05B 67/13; E05B 85/20; E05B 85/22; E05C 19/009; E05C 19/007; E05C 19/16; E05C 19/163; E05C 19/04; E05C 17/56
See application file for complete search history.

(56) References Cited

U.S. PATENT DOCUMENTS 5,791,172 A * 8/1998 Deighton ..... E05B 19/0005 292/199
6,047,575 A 4/2000 Larson et al.
6,094,953 A 8/2000 Evans
6,442,983 B1 9/2002 Thomas et al.
6,588,243 B1 7/2003 Hyatt, Jr. et al.
7,552,822 B2 6/2009 Belden, Jr. et al.
7,891,220 B2 2/2011 Yen et al.
7,999,656 B2 8/2011 Fisher
8,151,608 B2 4/2012 Fisher et al.
8,225,629 B2 7/2012 Zuraski et al.
8,635,893 B2 1/2014 Miller et al.
8,914,951 B2 * 12/2014 Gaudillere ..... A44B 11/266 24/303
2002/0149208 A1 * 10/2002 Zamberg ..... E05C 19/105 292/98
2004/0141414 A1 7/2004 Huffman et al.
2005/0206499 A1 * 9/2005 Fisher ..... E05B 47/0603 340/5.73
2006/0213237 A1 * 9/2006 Yang ..... E05B 19/0005 70/63
2007/0029816 A1 * 2/2007 Chen ..... E05B 47/004 292/251.5
2010/0289276 A1 * 11/2010 Tang ..... E05B 51/005 292/263
2012/0174637 A1 * 7/2012 Larson ..... E05B 19/0005 70/456 R
2012/0291504 A1 * 11/2012 Oliana ..... E05B 47/004 70/452
2014/0339232 A1 * 11/2014 Fiedler ..... A44B 11/258 220/348
2016/0002953 A1 1/2016 Sada

FOREIGN PATENT DOCUMENTS

EP 2372068 A2 * 10/2011 ..... E05B 19/0005
WO WO-2007069047 A2 * 6/2007 ..... E05B 47/0692
WO 2010037874 A1 4/2010
WO 2015140585 A1 9/2015

OTHER PUBLICATIONS

Stockwell et al.; "Part One: High Security, Robust Locking Applications, Ball-Detent Locking Solenoids (U.S. Appl. No. 14/592,511)"; Magnet-Schultz of America Blog; Apr. 2015; http://blog.magnet-schultzamerica.com/blog/linear-motor_theory-of-operation-0-0-3.
Written Opinion for International Application No. PCT/US2018/020256, International Filing Date Feb. 28, 2018, dated Jun. 4, 2018, 8 pages.

* cited by examiner

LOCKING MODULE

CROSS REFERENCE TO RELATED APPLICATIONS

This application is a National Stage application of PCT/US2018/020256, filed Feb. 28, 2018, which claims the benefit of U.S. Provisional Application No. 62/465,453, filed Mar. 1, 2017, both of which are incorporated by reference in their entirety herein.

BACKGROUND

This disclosure relates generally to a lockable device and, more particularly, to a locking module for use in a lockable device.

Lockboxes typically provide a secured storage area for a key or other access aid at a location close to a locked property accessible by the key. In this way, an authorized user can unlock the lockbox to gain access to the secured storage area and then use the key contained therein to unlock the locked property.

The lockbox is typically attached to a door handle or to another stationary object near the traditional lock. The lockbox typically requires the user to demonstrate that he is authorized to obtain access to the locked property before the secured storage area is unlocked to allow the user to obtain the key. In a mechanical lockbox, the user might be required to enter a correct lock combination to access the secured storage area. In an electronic lockbox, the user might be required to communicate a credential to lockbox (via a physical connection to the lockbox or via a wireless link to the lockbox) to access the secured storage area.

Some lockboxes are relatively easy to break into to access the contents within the secured storage area. For example, simply dropping the lockbox or using a magnet to operate the locking module therein makes conventional lockboxes susceptible to vandalism. There is therefore a need for a more robust lockbox.

SUMMARY

According to one embodiment, a locking module for selectively coupling a first component and a second component of a lockable device includes a housing and a magnet arranged within said housing. A locking element is movable relative to said housing between an unlocked position and a locked position. An engagement member is rotatable about an axis to selectively decouple said locking element from said magnet to move said locking element between said unlocked position and said locked position.

In addition to one or more of the features described above, or as an alternative, in further embodiments in said locked position, said locking element is separated from said housing.

In addition to one or more of the features described above, or as an alternative, in further embodiments said engagement member includes at least one engagement plate positionable between said locking member and said housing.

In addition to one or more of the features described above, or as an alternative, in further embodiments the second component includes a detent and when said locking element is in said unlocked position, said locking element is not arranged within said detent.

In addition to one or more of the features described above, or as an alternative, in further embodiments said locking element includes a magnetic component including a magnetic material.

In addition to one or more of the features described above, or as an alternative, in further embodiments said locking element includes base, said magnetic component being movable relative to said base.

In addition to one or more of the features described above, or as an alternative, in further embodiments said engagement member includes a contoured surface configured to cooperate with said locking element.

In addition to one or more of the features described above, or as an alternative, in further embodiments said contoured surface includes a logarithmic camming surface.

In addition to one or more of the features described above, or as an alternative, in further embodiments said magnet is a permanent magnet.

In addition to one or more of the features described above, or as an alternative, in further embodiments said magnet is formed from an alloy of neodymium.

In addition to one or more of the features described above, or as an alternative, in further embodiments comprising a mechanism operably coupled to said engagement member.

In addition to one or more of the features described above, or as an alternative, in further embodiments wherein said mechanism is a mechanical mechanism that operates the engagement member in response to a user input.

In addition to one or more of the features described above, or as an alternative, in further embodiments wherein said mechanism is an electromechanical mechanism that operates the engagement member in response to a user input.

In addition to one or more of the features described above, or as an alternative, in further embodiments said mechanism moves said engagement member in a first direction and said engagement member is operable to apply a normal force to said locking element.

According to another embodiment, a method of operating a locking module of a lockable device includes operating a mechanism in response to a user input, rotating an engagement member operably coupled to said mechanism out of contact with a locking element of the locking module, and attracting said locking element with a magnetic field to move said locking element from a first position to a second position.

In addition to one or more of the features described above, or as an alternative, in further embodiments said magnetic field acts on said locking element in both said first position and said second position.

In addition to one or more of the features described above, or as an alternative, in further embodiments a permanent magnet is arranged within a housing of the locking module to attract said locking element.

In addition to one or more of the features described above, or as an alternative, in further embodiments said mechanism is operable in response to a mechanical input.

In addition to one or more of the features described above, or as an alternative, in further embodiments said mechanism is operable in response to an electromechanical input.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1A:
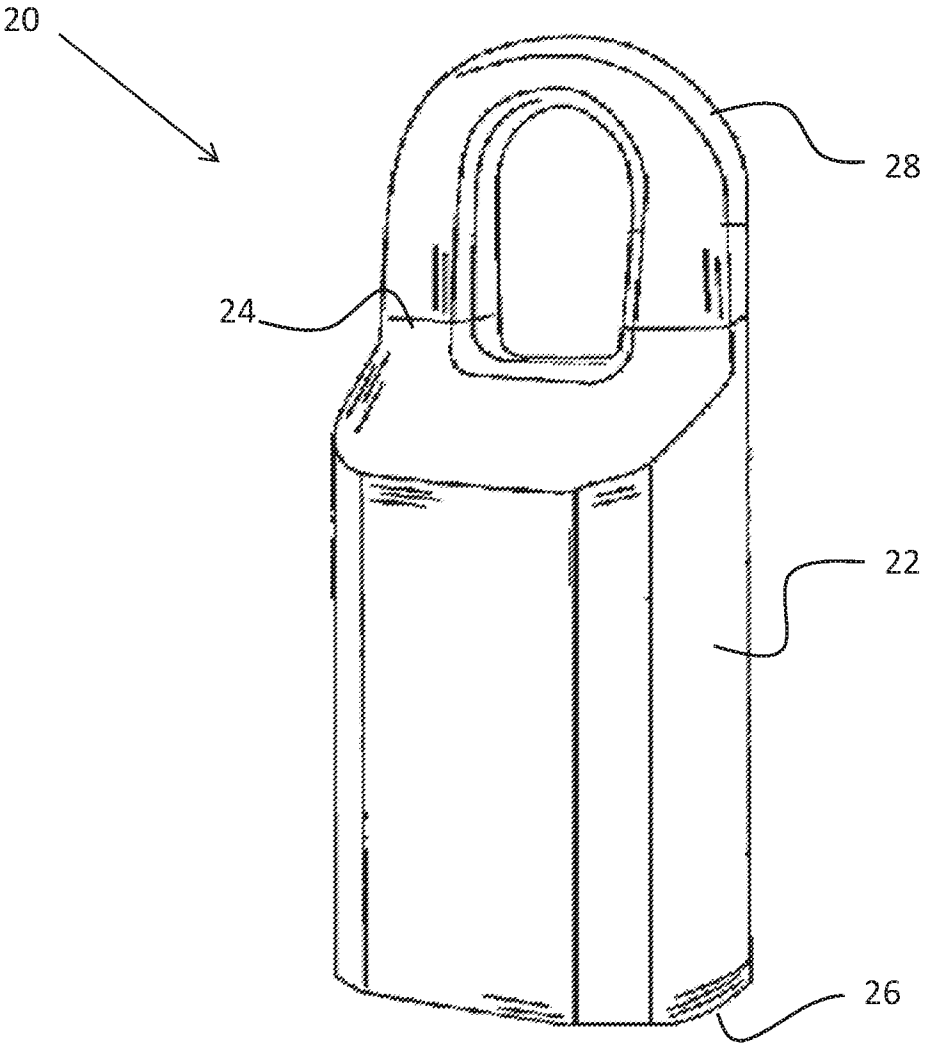
FIG. 1A is a perspective view of an example of a lockable device in a closed configuration.
Figure 1B:
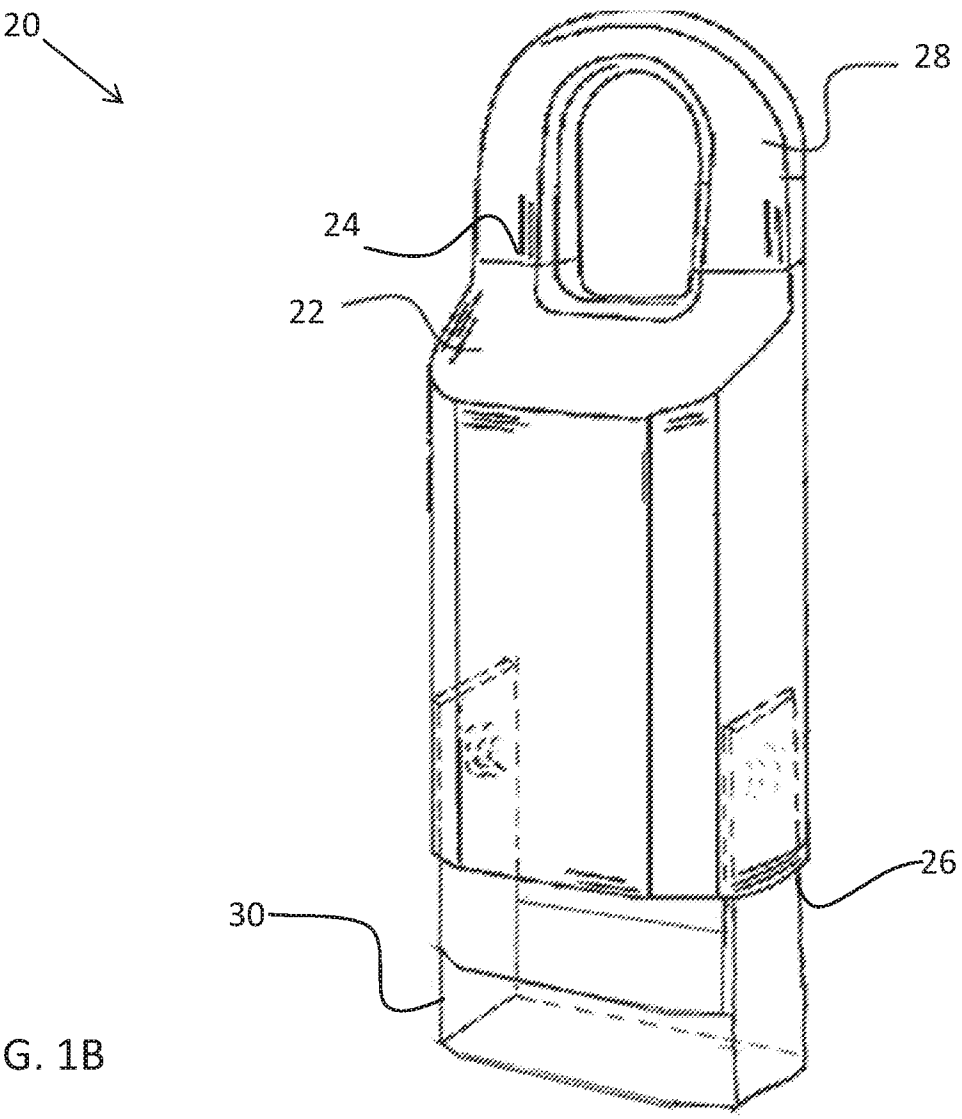
FIG. 1B is a perspective view of an example of a lockable device having a keybox in an extended position.

Referring now to FIGS. 1A and 1B, an example of a lockable device 20, such as a lockbox is illustrated. The lockbox 20 includes a body 22 and one or more components movable relative to the body 22. For example, the lockbox 20 additionally includes a shackle 28 positioned adjacent a first end 24 of the body 22 and a keybox 30 (best shown in FIG. 1B) positioned adjacent a second, opposite end 26 of the body 22. The shackle 28 may be configured to translate and/or rotate relative to the body 22. Alternatively, or in addition, the keybox 30 may be configured to translate relative to the body 22. In an embodiment, at least one of the shackle 28 and the keybox 30 is separable from the body 22.

A locking module 40 (FIGS. 2-4) is operable to selectively couple a first component and a second component. When applied to a lockable device, such as lockbox 20 for example, the locking module 40 selectively locks the shackle 28 to the body 22. Accordingly, the locking module 40 restricts movement of the lockbox 20 once arranged in a desired location via the shackle 28. Alternatively or in addition, the locking module 40 may be used to selectively lock the keybox 30 to the body 22. In such instances, operation of the locking module 40 may provide an authorized user with access to the internal cavity of the keybox 30, within which one or more items, such as a key for example, may be stored.

Figure 2:
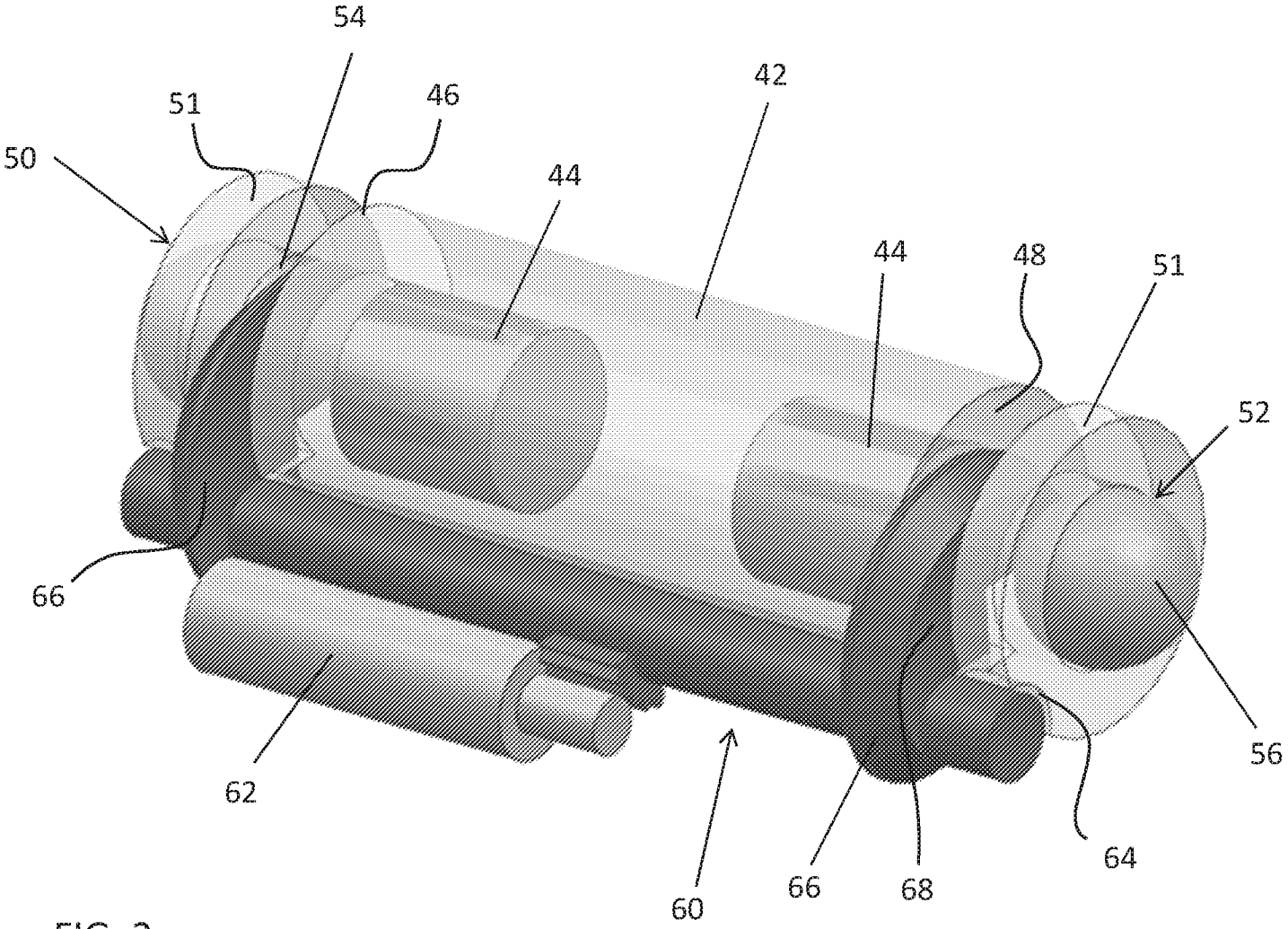
FIG. 2 is a perspective view of a locking module of the lockable device in a locked configuration according to an embodiment.
Figure 3:
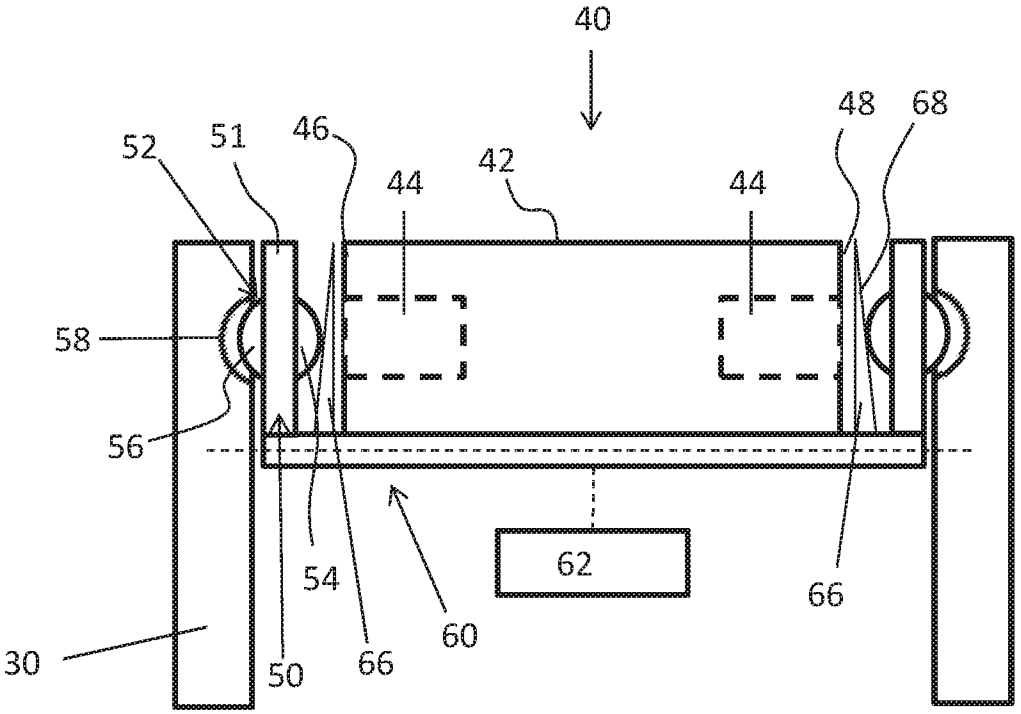
FIG. 3 is a front view of the locking module of FIG. 2 in a locked configuration.
Figure 4:
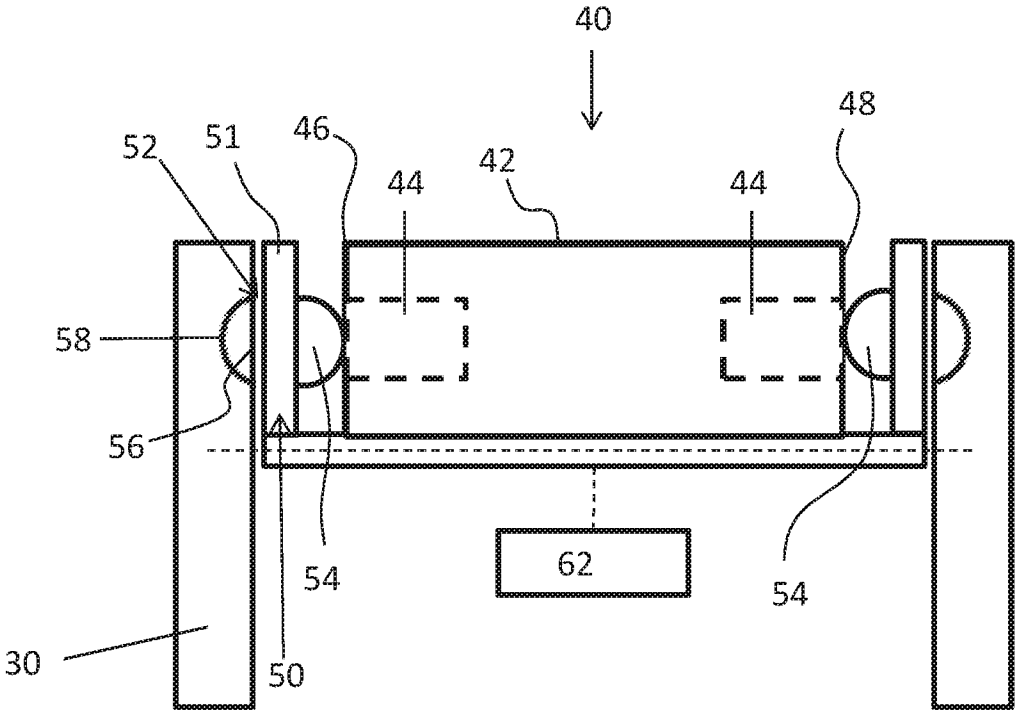
FIG. 4 is a front view of the locking module of FIG. 2 in an unlocked configuration.

With reference now to FIGS. 2-4, an example of a locking module 40 configured to selectively couple the keybox 30 to the body 22 of a lockbox 20 is illustrated in more detail. As shown, the locking module 40 includes a housing 42 having at least one magnet 44 arranged within the interior of the housing 42. In the illustrated, non-limiting embodiment, a first magnet is arranged within the interior, adjacent a first end 46 of the housing 42 and a second magnet 44 is arranged within the interior of the housing 42 adjacent a second, opposite end 48 thereof. The magnets 44 may, but need not be substantially identical. In an embodiment, the magnets 44 are permanent magnets, such as made from an alloy of neodymium for example. However, other types of magnets, for example electromagnets, are also within the scope of the disclosure.

A locking element 50 is positioned generally adjacent each end 46, 48 of the housing 42. The locking element 50 includes a base 51 and a magnetic component 52 movably connected to the base 51. A first portion 54 of the magnetic component 52 is positioned generally adjacent the housing 42 and a second portion 56, opposite the first portion 54, faces away from the housing 42. In an embodiment, the portion 54 of the magnetic component 52 directly adjacent the housing 42 has a generally rounded, for example spherical, contour. However, other non-planar configurations are also within the scope of the disclosure. In the illustrated, non-limiting embodiment, the two substantially identical locking elements 50 of the locking module 40 are operable to selectively engage opposing sides of the keybox 30. However, embodiments including only a single magnet 44 and corresponding locking element 50 are also contemplated herein.

The magnetic component 52 of the locking element 50 may be formed from or include any suitable magnetic material. In some embodiments, a suitable magnetic material includes a composite magnetic material, or alternatively, may include a non-magnetic material having a separate magnetic component or material attached to a portion thereof. In an embodiment, the magnetic component 52 is formed from a material having a high shear strength, such as about 10,000 lbs for example.

The magnetic component 52 of the locking element 50 is movable between a first "locked" position, illustrated in FIGS. 2 and 3, a second "unlocked" position (FIG. 4). In an embodiment, in the locked position, the portion 56 of the magnetic component 52 extending away from the housing 42 is received within a groove or detent 58 formed in a surface of the movable component, such as the keybox 30 for example. The detent 58 is generally aligned with the magnetic component 52 and may have a size and shape generally complementary to the portion 56 of the magnetic component 52 receivable therein. When the magnetic portion 52 of the locking element 50 is in the unlocked position, portion 56 of the magnetic component 52 is moved out of engagement with the detent 58, thereby allowing relative movement between the keybox 30 and the body 22.

The locking module 40 additionally includes an engagement member 60 movable relative to the body 22 and the housing 42 to selectively decouple the magnet 44 and the magnetic component 52 of the locking element 50. As previously described, this decoupling of the magnetic component 52 and the magnet 44 is intended to "lock" the locking module 40 and limit movement of the keybox 30. In the illustrated, non-limiting embodiment, the engagement member 60 is operably coupled to a mechanism, illustrated schematically at 62. The mechanism 62 is configured to rotate the engagement member 60 about an axis. The mechanism 62 for moving the engagement member 60 may be mechanically operated by a user, or alternatively, may include an electromechanical mechanism, such as a motor, solenoid, or a piezoelectric device for example, directly or indirectly coupled thereto. In such embodiments, the mechanism 62 may be operable in response to an electrical input, such as generated by a code entered via a key pad or upon detection of an identification device, such as an RFID tag for example, having acceptable credentials.

As shown, the engagement member 60 is located within a complementary groove 64 (see FIG. 2) formed in the periphery of the housing 42 and the locking element 50. The engagement member 60 additionally includes an engagement plate 66 positioned between the ends 46, 48 of the housing 42 and the adjacent locking element 50. The engagement plate 66 has a knife-like edge and the portion of the engagement plate 66 facing the magnetic component 52 has a non-planar surface 68 contoured to facilitate separation of the magnetic component 52 from the housing 42. In an embodiment, surface 68 of the engagement plate 62 includes a specially shaped logarithmic camming surface configured to optimally convert rotation of the engagement member 60 into work. The surface 68 of the engagement plate 62 cooperates with portion 54 of the magnetic component 52 to move the magnetic component 52 of the locking element 50 between the locked and the unlocked positions. Although the magnetic component 52 illustrated in the FIGS. is generally spherical in shape, embodiments having any shape configured to cooperate with the contoured surface 68 and detent 58, such as a cylindrical dowel having a rounded portion 54 for example, are also within the scope of the disclosure.

In operation, a user provides an input to operate the mechanism 62 associated with the engagement member 60. In response to the input, the mechanism 62 rotates the engagement member 60 out of contact with the magnetic component 52 and the housing 42. The strength of the magnetic force of the magnet 44 attracts the magnetic component 52 of the locking element 50, thereby moving the magnetic component 52 from within the detent 58 formed in the keybox 30 to the unlocked position. In some embodiments, as shown, the magnetic force of the magnet 44 may cause the magnetic component 52 of the locking element 50 to move into contact with the magnet 44. In other embodiments, when the locking element 44 is in the unlocked position, the locking element 44 is in direct contact with the housing 42, but not the magnet 44.

To lock the locking module 40, the mechanism 62 is operated to rotate the engagement member 60, and more specifically the engagement plate 66, towards the housing 42 and magnetic component 52. As the engagement member 60 rotates, the contoured surface 68 of the engagement plate 64 acts like a wedge and applies a force to the magnetic component 52. The camming surface 68 moves the magnetic component 52 in a direction substantially perpendicular to the plane of movement of the engagement plate 66, such that the portion 56 of the magnetic component 52 is received within the detent 58 formed in the keybox 30. In some embodiments, the mechanism 62 is not operable when the housing 42 of the locking module 40 and the keybox 30 are not aligned.

The locking module 40 illustrated and described herein has a simplified configuration, thereby reducing cost. Through use of a magnet 44, operation of the locking module 40 may be accomplished in any position with respect to gravity. Further, the high shear strength of the magnetic component 52 limits the ability to operate the locking module 40 through vandalism. Additionally, in the event that the magnetic component 52 is temporarily separated from the magnet 44, the strength of the magnet 44 will attract the magnetic component 52 such that the locking module 40 has a self-restoring property.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A locking module for selectively coupling a first component and a second component of a lockable device comprising:

a housing;

a magnet arranged within said housing;

a locking element laterally spaced from said housing, said locking element having a base and a magnetic component, said base being laterally spaced from said housing, said magnetic component being movable relative to said base and to said housing between an unlocked position and a locked position, said magnetic component being separated from said housing when in said locked position; and an engagement member rotatably mounted within a complementary groove formed at a periphery of said housing and said locking element, said engagement member being rotatable about an axis to selectively decouple said magnetic component from said magnet, said engagement member including an engagement plate insertable between said magnet and said locking element to move said magnetic component between said unlocked position and said locked position in response to rotation of said engagement member.

2. The locking module of claim 1, wherein the second component includes a detent and when said locking element is in said unlocked position, said locking element is not arranged within said detent.

3. The locking module of claim 1, wherein said engagement member includes a contoured surface configured to cooperate with said locking element.

4. The locking module of claim 3, wherein said contoured surface includes a logarithmic camming surface.

5. The locking module of claim 1, wherein said magnet is a permanent magnet.

6. The locking module of claim 5, wherein said magnet is formed from an alloy of neodymium.

7. The locking module of claim 1, further comprising a mechanism operably coupled to said engagement member.

8. The locking module of claim 7, wherein said mechanism is a mechanical mechanism that operates the engagement member in response to a user input.

9. The locking module of claim 7, wherein said mechanism is an electromechanical mechanism that operates the engagement member in response to a user input.

10. The locking module of claim 7, wherein said mechanism moves said engagement member in a first direction and said engagement member is operable to apply a normal force to said locking element.

11. A method of operating a locking module of a lockable device comprising:

operating a mechanism in response to a user input;

rotating an engagement member operably coupled to said mechanism out of contact with a magnetic component of a locking element of the locking module, wherein said rotating said engagement member further comprises rotating said engagement member within a groove formed at a periphery of a housing of said mechanism and said locking element; and attracting said magnetic component of said locking element with a magnetic field of a magnet to move said magnetic component of said locking element relative to a base of said locking element from a first position to a second position;

wherein said engagement member includes an engagement plate axially positioned between said magnetic portion and said magnet and said rotating said engagement member further comprises rotating said engagement plate between said magnet and said magnetic portion of said locking element, said engagement plate contacting said magnetic component during said rotation.

12. The method of claim 11, wherein said magnetic field acts on said locking element in both said first position and said second position.

13. The method of claim 11, wherein a permanent magnet is arranged within a housing of the locking module to attract said locking element.

14. The method of claim 11, wherein said mechanism is operable in response to a mechanical input.

15. The method of claim 11, wherein said mechanism is operable in response to an electromechanical input.

* * * * *